US006338224B1

(12) United States Patent
Sembommatsu

(10) Patent No.: US 6,338,224 B1
(45) Date of Patent: Jan. 15, 2002

(54) MOVEMENT TRANSMISSION MECHANISM INSTALLED IN AUTOMOTIVE DOOR

(75) Inventor: Kazuyoshi Sembommatsu, Yokohama (JP)

(73) Assignee: Ohi Seisakusho Co., Ltd., Yokohama (JP)

( * ) Notice: Subject to any disclaimer, the term of this patent is extended or adjusted under 35 U.S.C. 154(b) by 0 days.

(21) Appl. No.: 09/594,723

(22) Filed: Jun. 16, 2000

(30) Foreign Application Priority Data

Jun. 18, 1999 (JP) ..... 11-172687

(51) Int. Cl.[7] ..... E06B 3/00
(52) U.S. Cl. ..... 49/503; 292/348
(58) Field of Search ..... 49/360, 503, 279, 49/280; 292/DIG. 65, DIG. 22, 348; 70/208

(56) References Cited

U.S. PATENT DOCUMENTS 5,308,130 A * 5/1994 Lee ..... 292/DIG. 65
5,605,363 A * 2/1997 Kapes ..... 292/DIG. 65
5,975,597 A 11/1999 Makiuchi et al. ..... 292/336.3

FOREIGN PATENT DOCUMENTS

JP 10-58980 * 10/1998 ..... 49/502
JP 10-317739 12/1998

* cited by examiner

*Primary Examiner*—Jerry Redman
(74) *Attorney, Agent, or Firm*—Foley & Lardner

(57) ABSTRACT

A door includes outer and inner panels which are combined to define therebetween a given space. A window pane is vertically movably installed in the given space, an actuating device is connected to the outer panel, an actuated device is connected to the inner panel; and a movement transmission mechanism is arranged for transmitting a movement of the actuating device to the actuated device. The movement transmission mechanism includes a U-shaped arm structure that straddles a front edge of the window pane leaving a space therebetween.

8 Claims, 6 Drawing Sheets

MOVEMENT TRANSMISSION MECHANISM INSTALLED IN AUTOMOTIVE DOOR

BACKGROUND OF THE INVENTION

1. Field of the Invention

The present invention relates in general to movement transmission mechanisms for use in automotive doors, and more particularly to the movement transmission mechanisms of a type that can be installed in the door in such a manner as to allow a window pane of the door to have a satisfied width, that is, a satisfied size in a fore-and-aft direction of the associated motor vehicle.

2. Description of the Prior Art

In order to clarify the task of the present invention, a prior art movement transmission mechanism for an automotive door will be briefly described with reference to FIG. 6 of the accompanying drawings.

FIG. 6 is a partially sectioned plan view of a slide door 1 for a motor vehicle, to which the prior art movement transmission mechanism is practically applied. The slide door 1 comprises an outer panel 2 and an inner panel 3 between which a certain space is defined. A window pane 4 is vertically movably received in the space. An outside door handle 5 is connected to an outer surface of the outer panel 2. A locking/unlocking mechanism 6 is connected to an inner surface of the inner panel 3. An outside lever 7 is installed in the space beside a front edge of the window pane 4, that extends straightly from the outside door handle 5 to a part of the locking/unlocking mechanism 6.

When the outside door handle 5 is manipulated, the movement of the same is transmitted through the outside lever 7 and the locking/unlocking mechanism 6 to a release lever to cause a door latch to take an unlocked condition. With this, the slide door 1 becomes ready for opening.

However, due to provision of the outside lever 7 that extends straightly from the outside door handle 5 to the locking/unlocking mechanism 6, the window pane 4 fails to have a satisfied width, that is, a satisfied dimension in the fore-and-aft direction of the associated motor vehicle.

Japanese Patent First Provisional Publication 10-317739 discloses a measure to provide such a window pane with a satisfied width. That is, in the measure, for transmitting the movement of an outside door handle to the locking/unlocking mechanism, a transmission link mechanism including a sub-link, a bell crank and an open rod is used, that is arranged to straddle a front edge of the window pane.

However, the transmission link mechanism disclosed by the publication has a number of parts installed therein, that inevitably increases the cost.

SUMMARY OF THE INVENTION

It is therefore an object of the present invention to provide a movement transmission mechanism for an automotive door, that is free of the above-mentioned drawbacks.

According to a first aspect of the present invention, there is provided an arrangement for use in a door. The door includes outer and inner panels which are combined to define therebetween a given space. The arrangement comprises a window pane vertically movably installed in the given space; an actuating device connected to the outer panel; an actuated device connected to the inner panel; and a movement transmission mechanism for transmitting a movement of the actuating device to the actuated device, the movement transmission mechanism including a U-shaped arm structure that straddles an edge of the window pane leaving a space therebetween.

According to a second aspect of the present invention, there is provided an arrangement for use in an automotive slide door. The door includes outer and inner panels which are combined to define therebetween a given space. The arrangement comprises a window pane vertically movably installed in the given space; an outside door handle connected to the outer panel; a locking/unlocking mechanism connected to the inner panel, the locking/unlocking mechanism having an outside lever which induces an unlocked condition of an associated door latch when pivoted in a given direction; and a movement transmission mechanism for transmitting a movement of the outside door handle to the outside lever of the locking/unlocking mechanism to induce the unlocked condition of the door latch, the movement transmission mechanism comprising a U-shaped arm structure including a first side wall portion that faces an inside surface of the window pane and is integral with the outside lever, a second side wall portion that faces an outside surface of the window pane and a bridge portion that extends between the first and second side wall portions in front of a front edge of the window pane; and a connecting rod having one end pivotally connected to the outside door handle and the other end pivotally connected to the second side wall portion of the U-shaped arm structure.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Referring to FIGS. 1 to 5 of the drawings, there is shown a movement transmission mechanism of the present invention.

Figure 2:
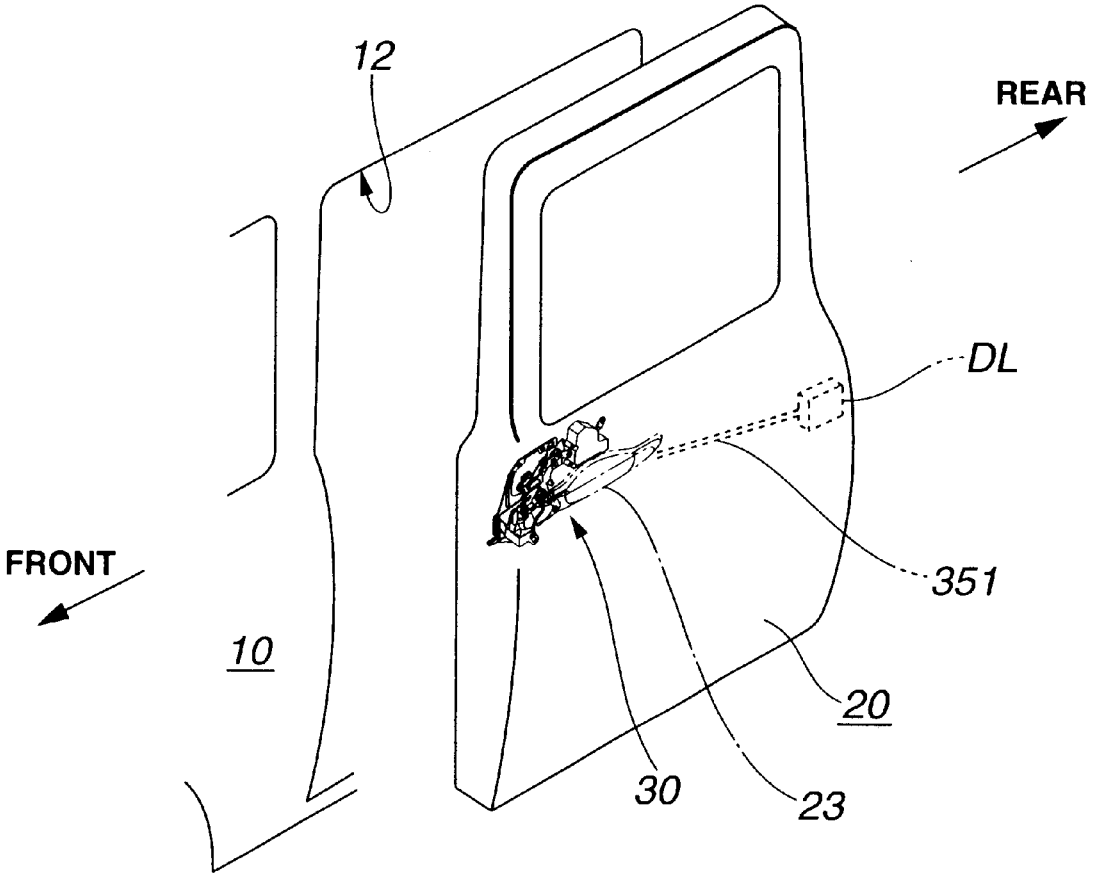
FIG. 2 is a perspective view of the slide door in association with a van-type motor vehicle.
Figure 3:
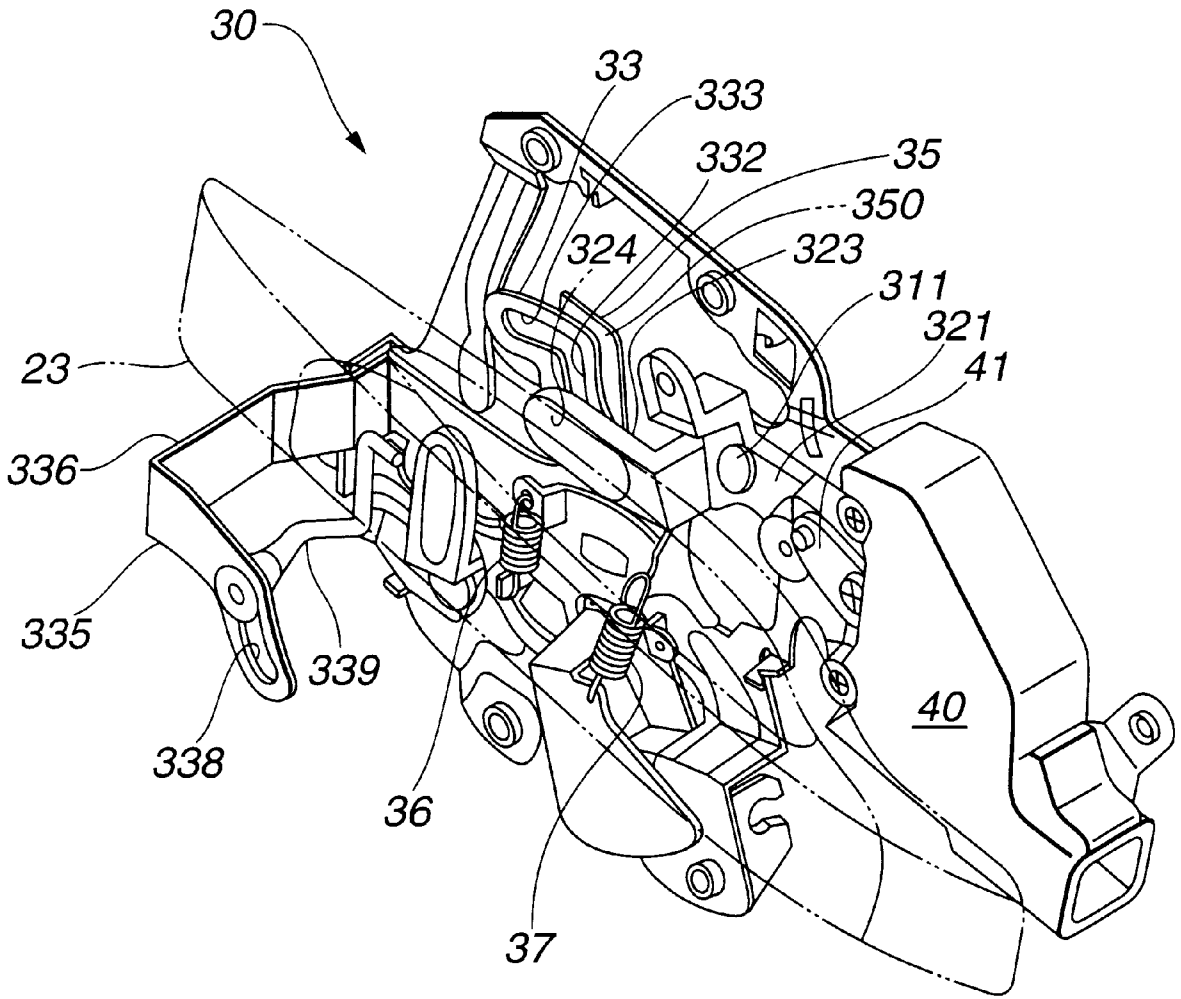
FIG. 3 is a perspective view of a locking/unlocking mechanism that has the movement transmission mechanism of the present invention practically incorporated therewith.

As is seen from FIG. 2, the movement transmission mechanism is applied to a slide door 20 of a van-type motor vehicle 10. That is, the slide door 20 slides in a horizontal direction to close and open a door opening 12 formed in a side body of the vehicle 10.

As will be described in detail hereinafter, the movement transmission mechanism of the invention is incorporated with a locking/unlocking mechanism 30 installed in a front part of the door 20. A door latch "DL" is installed in a rear part of the door 20, and a cable 351 extends between the door latch "DL" and the locking/unlocking mechanism 30. A striker (not shown) is fixed to a rear end of the door opening 12. The door latch "DL" comprises a latch plate that can engage with the striker and a locking plate that can lock the latch plate in the engaged position. That is, the latch plate can assume a full-open position to release the striker, a half-latch position to incompletely latch the striker and a full-latch position to fully latch the striker. The locking plate can assume a locking position to lock the latch plate in the full-latch position, and an unlocking position to release the latch plate.

Figure 1:
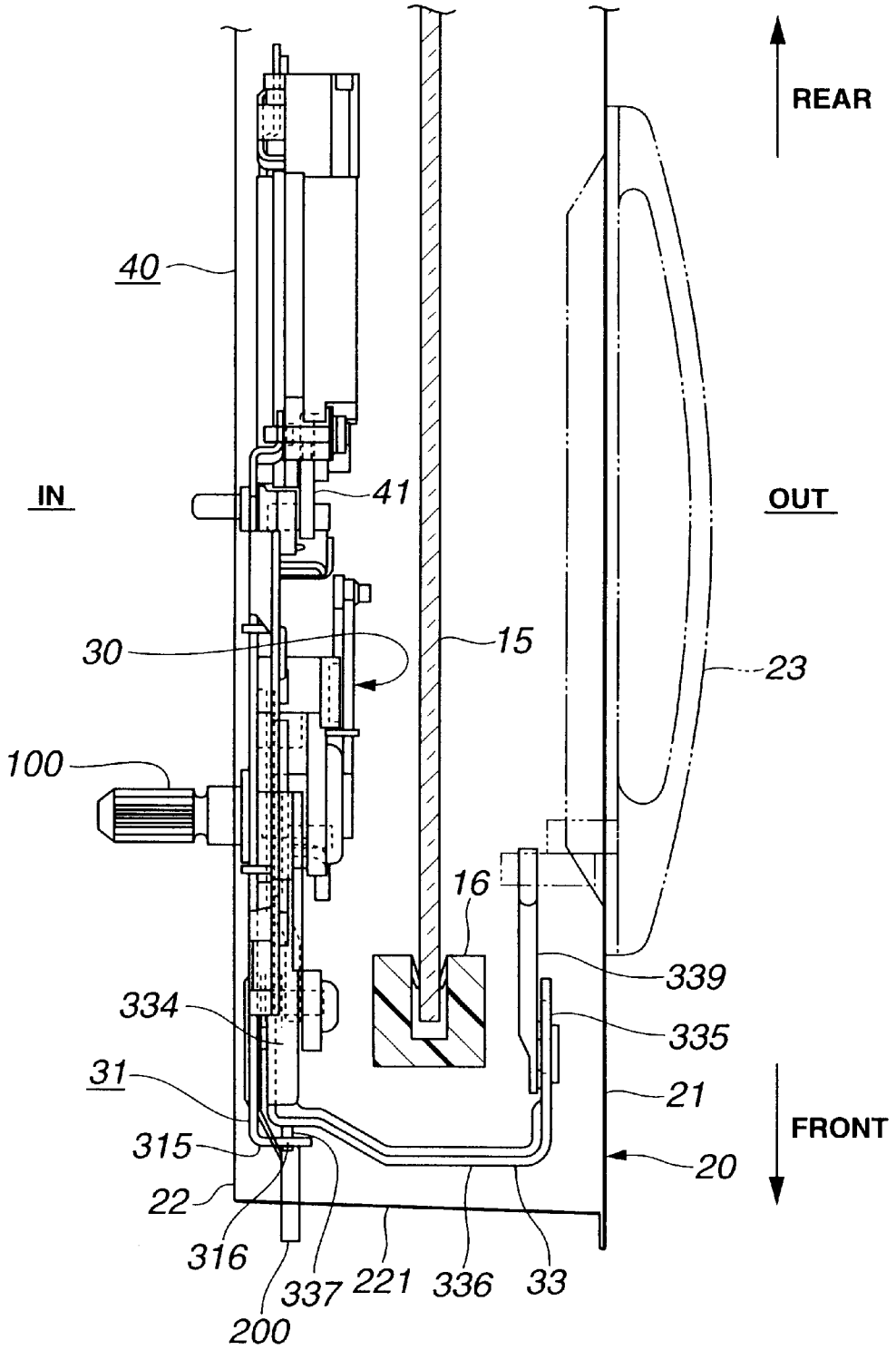
FIG. 1 is a partially sectioned plan view of an automotive slide door, to which a movement transmission mechanism of the present invention is practically applied.

As is seen from FIG. 1, the slide door 20 comprises an outer panel 21 and an inner panel 22 which define therebetween a certain space. Within the space, there is vertically movably received a window pane 15.

An outside door handle 23 is mounted to an outer surface of the outer panel 21. On an inner surface of the inner panel 22, there is mounted the locking/unlocking mechanism 30. As is seen from the drawing, the outside door handle 23 and the locking/unlocking mechanism 30 are arranged at a front part of the slide door 20. As is mentioned hereinabove, the door latch "DL" is arranged at a rear part of the slide door 20.

Figure 5:
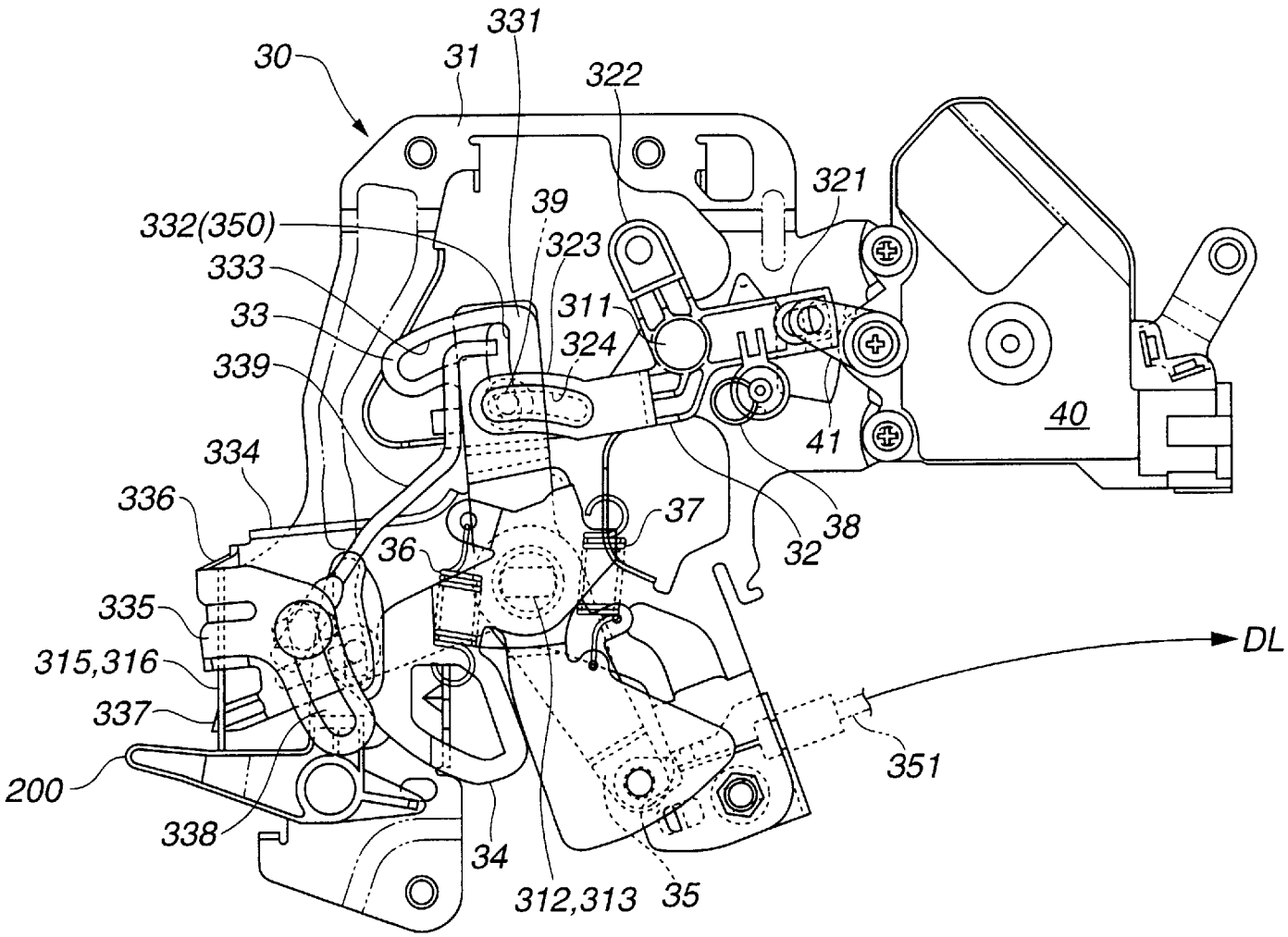
FIG. 5 is a front view of the locking/unlocking mechanism that has the movement transmission mechanism of the invention.
Figure 6:
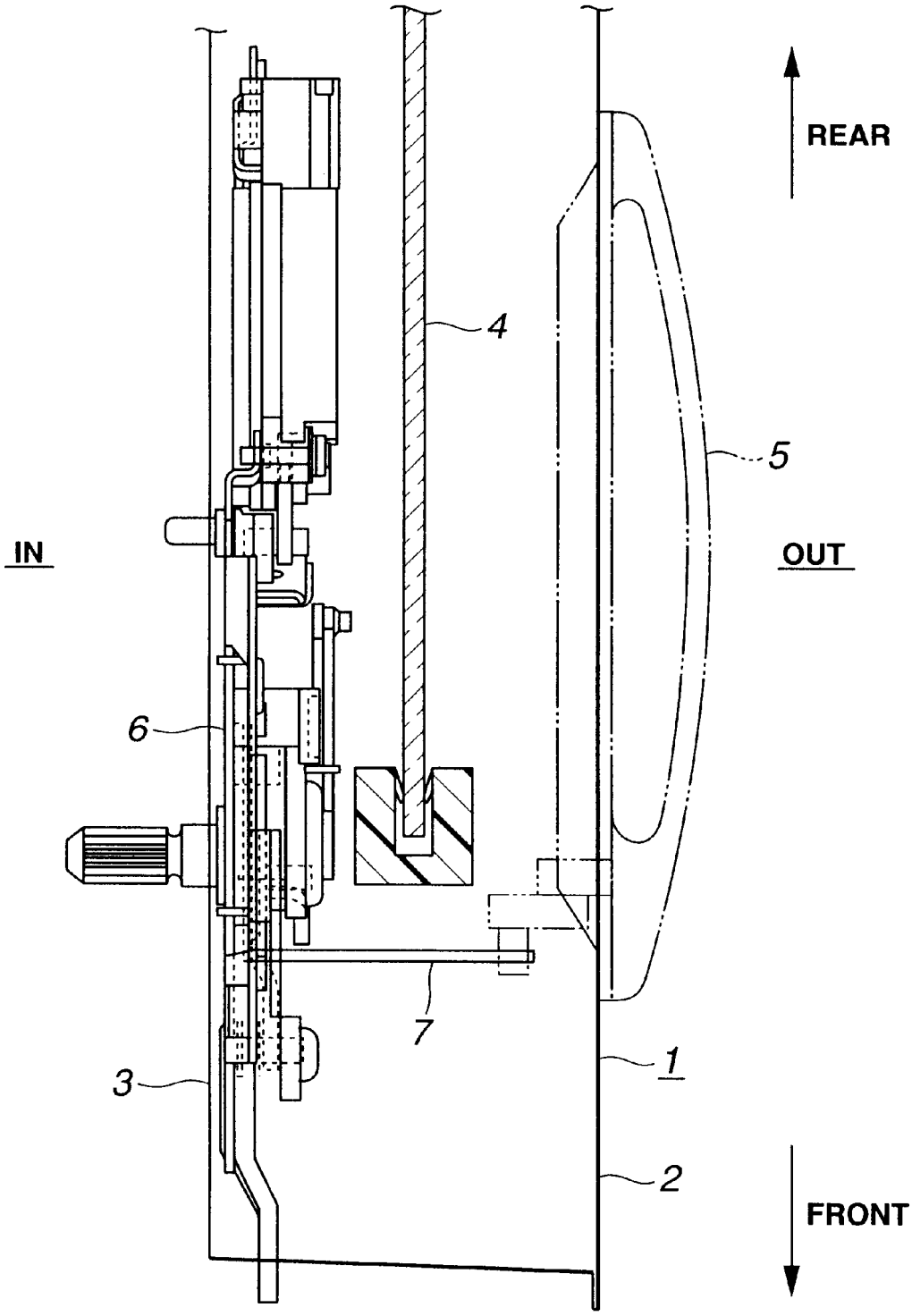
FIG.6 (PRIOR ART)
FIG. 6 is a partially sectioned plan view of an automotive slide door, to which a known movement transmission mechanism is applied.

As is seen from FIGS. 1 and 5, an electric knob actuator 40 is incorporated with the locking/unlocking mechanism 30. These actuators 40 and the locking/unlocking mechanism 30 has a common base plate 31.

As is seen from FIG. 5, a knob lever 32 is pivotally connected to the base plate 31 through a pivot pin 311. A turn-over spring 38 is incorporated with the knob lever 32, so that due to snap action of the spring 38, the knob lever 32 can pivot about the pivot pin 311 in clockwise and counterclockwise directions to assume a locking position and an illustrated unlocking position, respectively.

The knob lever 32 comprises first, second and third arms 321, 322 and 323 which extend radially outward from the pivoted portion thereof. The first arm 321 is pivotally connected to a drive arm 41 of the knob actuator 40 and a control knob (not shown), the second arm 322 is pivotally connected to a key cylinder (not shown) and the third arm 323 is pivotally connected to an outside lever 33.

To the base plate 31, there is pivotally connected a pivot shaft 312. It is to be noted that the pivot shaft 312 is integral with a shaft 100 (see FIG. 1) to which an inside door handle (not shown) is connected.

The pivot shaft 312 has a major portion 313 to which the outside lever 33, an inside lever 34 and a release lever 35 are pivotally connected. The knob lever 32, the inside lever 34 and the release lever 35 are biased to rotate about the pivot shaft 312 in a counterclockwise direction in FIG. 5 by means of springs 36 and 37. The release lever 35 is connected to the locking plate of the above-mentioned door latch through the cable 351.

The outside lever 33 is formed through the cable 351. The arm portion 331 is formed with a generally L-shaped slot that includes a first arcuate part 332 and a second arcuate part 333 which is concentric with the pivot shaft 312. It is to be noted that when the outside lever 33 assumes the leftmost position as shown in FIG. 5, the first arcuate part 332 is concentric with the pivot pin 311. The third arm 323 of the knob lever 32 is formed with an arcuate groove 324. It is to be noted that when the third arm 323 assumes its lowermost position, the arcuate groove 324 is concentric with the pivot shaft 312. A pin member 39 is slidably engaged with the L-shaped slot (332, 333), that has one end slidably engaged with the arcuate groove 324 of the third arm 323 of the knob member 32 and the other end slidably engaged with an arcuate slot 350 formed in the release lever 35. It is to be noted that when the arcuate slot 350 of the release lever 35 assumes its leftmost position, the same is concentric with the pivot pin 311.

The outside lever 33 is integrally formed with a generally U-shaped arm structure that includes first and second side wall portions 334 and 335 and a bridge portion 336 that extends between the side wall portions 334 and 335.

As is seen from FIG. 1, upon assembly, the generally U-shaped arm structure (334, 335, 336) is arranged to straddle a front edge of the window pane 15 leaving a certain space therebetween. That is, the first side wall 334 faces an inside surface of the window pane 15 and the second side wall portion 335 faces an outside surface of the window pane 15. The bridge portion 336 extends laterally in front of the front edge of the window pane 15, as shown.

As is seen from FIG. 1, the bridge portion 336 is curved in a direction away from the front edge of the window pane 15.

Designated by numeral 16 is a front vertically extending pane runner installed in the door 20 for running the window pane 15. As shown, the bridge portion 336 of the U-shaped arm structure extends along a front wall part 221 of the inner panel 22 of the door 20.

Figure 4:
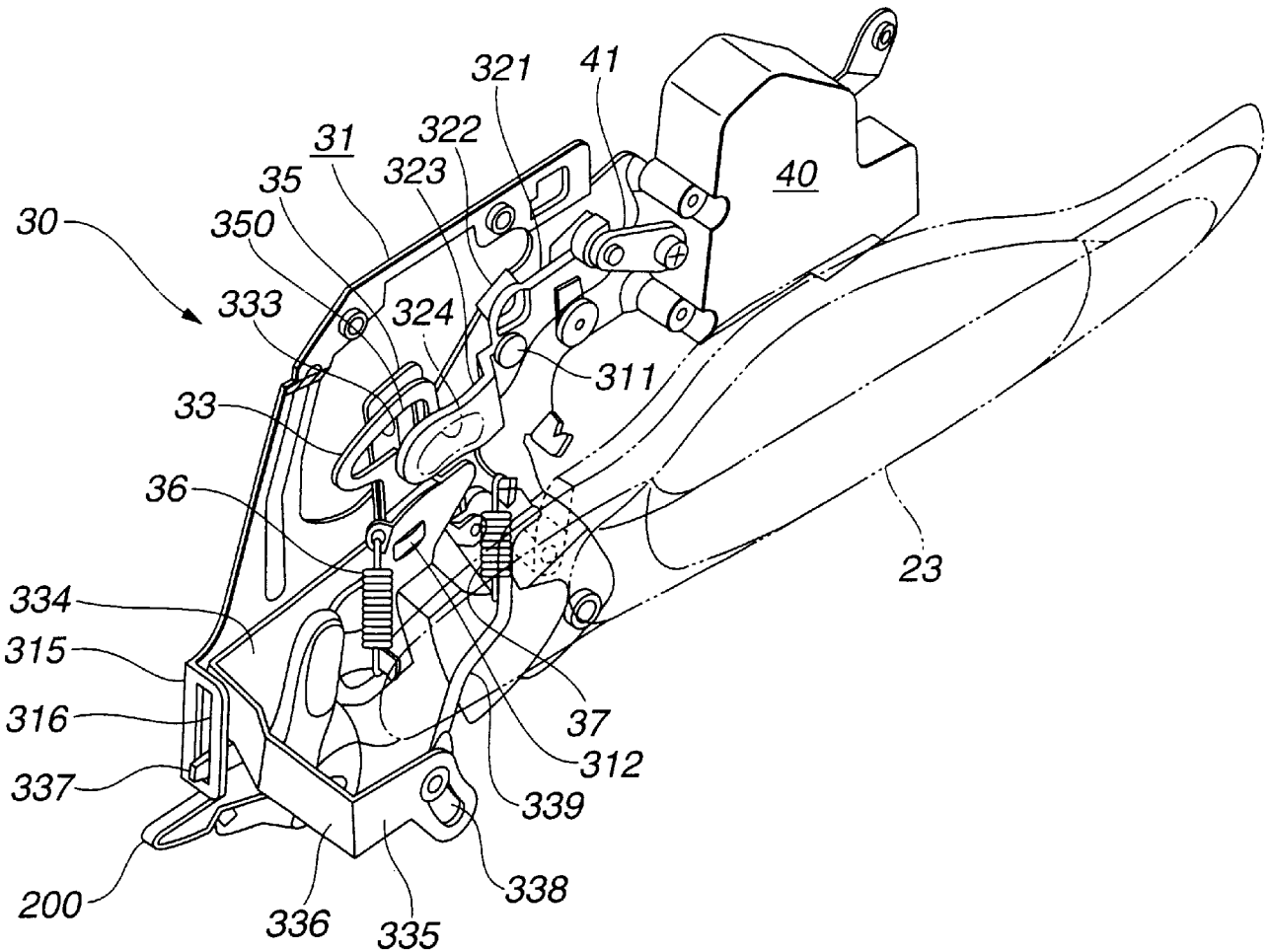
FIG. 4 is a view similar to FIG. 3, but showing the locking/unlocking mechanism viewed from a different angle.

As is well shown in FIG. 4, the U-shaped arm structure is formed between the side wall 334 and the bridge portion 336 with a forwardly protruding pin 337. This pin 337 is slidably received in a vertically extending slot 316 formed in a rectangular flange 315 that is integrally provided by the base plate 31. That is, the pivoting movement of the outside lever 33 about the pivot shaft 312 is guided by a guide arrangement that comprises the slot 316 and the pin 337. More specifically, undesired play of the outside lever 33 relative to the base plate 31 is suppressed by the guide arrangement. Denoted by numeral 200 is a child lever. That is, when the child lever 200 assumes an ON position, the inside door handle becomes inoperative.

The side wall portion 335 of the U-shaped arm structure is formed with a downwardly extending elongate part that is formed with an arcuate slot 338. An end of a connecting rod 339 from the outside door handle 23 is slidably engaged with the arcuate slot 338. Thus, when the outside door handle 23 is manipulated for the purpose of opening the door 20, the outside lever 33 is pivoted upward from an illustrated lower position (in FIG. 4) to an upper position wherein the pin 337 abuts on an upper edge of the slot 316.

In the following, operation of the movement transmission mechanism of the present invention will be described with reference to the drawings.

For ease of understanding, the description will be commenced with respect to a closed condition of the slide door 20 and the locking/unlocking mechanism 30 assumes a condition as shown in FIG. 5. That is in this condition, the knob lever 32 assumes its releasing position, and the door latch "DL" (see FIG. 2) assumes its locked condition. In this condition, the pin member 39 abuts on both a lower end of the first arcuate part 332 of the L-shaped slot and a lower end of the arcuate slot 350 of the release lever 35.

When now the outside door handle 23 is manipulated, the connecting rod 339 transmits the movement of the handle 23 to the U-shaped arm structure (334, 335, 336) and thus to the outside lever 33. With this, the outside lever 33 is pivoted about the pivot shaft 312 in a clockwise direction (FIG. 5) together with the release lever 35, and thus the cable 351 is pulled by the release lever 35. During this clockwise pivoting of the outside lever 33, the pin member 39 slides in the arcuate groove 324 of the third arm 323 of the knob member 32 from its leftmost end to its rightmost end, thereby keeping the knob member 32 at the releasing position. Due to pulling of the cable 351 by the release lever 35, the locking plate of the door latch "DL" releases the latch plate thereby causing the same to release the striker. With this, the slide door 20 becomes ready for opening by hand.

When, with the locking/unlocking mechanism 30 assuming the condition of FIG. 5, the inside door handle connected to the shaft 100 (see FIG. 1) is manipulated, that is, turned in a clockwise direction in FIG. 5, both the outside lever 33 and the release lever 35 are pivoted in the same direction like in the case of the above-mentioned outside door handle 23. Thus, the door latch "DL" release the striker and thus the slide door 20 becomes ready for opening by hand.

When, with the locking/unlocking mechanism 30 assuming the condition of FIG. 5, a locking knob (not shown) is moved to a locking position, the knob lever 32 is pivoted about the pivot pin 311 in a clockwise direction (in FIG. 5) to take its uppermost position. With this, the pin member 39 slides upward in both the first arcuate part 332 of the L-shaped slot of the outside lever 33 and the arcuate slot 350 of the release lever 35.

When now the outside door handle 23 is manipulated, only the outside lever 33 is pivoted about the pivot shaft 312 leaving the release lever 35 at the original position. Thus, the cable 351 is not pulled by the release lever 35, and thus, the locked condition of the door latch "DL" is kept. That is, when the locking knob is in the locking position, the door latch "DL" is not unlocked even if the outside door handle 23 is manipulated. Similar to this, when the locking knob is in the locking position, the door latch "DL" is not unlocked even if the inside door handle is manipulated.

In the following, advantages of the present invention will be described.

First, as is easily understood from FIGS. 1 and 4, the bridge portion 336 of the U-shaped arm structure (334, 335, 336), that connects the outside lever 33 to the connecting rod 339 of the outside door handle 23, is arranged at a front end of the locking/unlocking mechanism 30. Thus, as is seen from FIG. 1, the U-shaped arm structure (334, 335, 336) provides the window pane 15 with a sufficiently large front space in the door 20, and thus, the width of the window pane 15, that is, the size in a fore-and-aft direction of the associated motor vehicle can be sufficiently increased.

Second, the U-shaped arm structure (334, 335, 336) is of a single metal member that can be easily produced by a metal stamping.

Third, the pin 337 provided by the U-shaped arm structure (334, 335, 336) is slidably received in the vertically extending slot 316 formed in the flange 315 of the base plate 31. Thus, the pivoting movement of the U-shaped arm structure (334, 335, 336) about the pivot shaft 312 is stably carried out. That is, a marked force applied to the U-shaped arm structure when the outside door handle 23 is manipulated is appropriately supported by the flange 315 through the pin 337.

The entire contents of Japanese Patent Application 11-172687 (filed Jun. 18, 1999) are incorporated herein by reference.

Although the invention has been described above with reference to the embodiment of the invention, the invention is not limited to such embodiment as described above. Various modifications and variations of such embodiment may be carried out by those skilled in the art, in light of the above descriptions.

What is claimed is:

1. In a door including outer and inner panels which are combined to define therebetween a given space, an arrangement comprising:

a window pane vertically movably installed in said given space;

an actuating device connected to said outer panel;

an actuated device connected to said inner panel; and a movement transmission mechanism for transmitting a movement of said actuating device to said actuated device, said movement transmission mechanism including a U-shaped arm structure that straddles an edge of said window pane leaving a space therebetween, said U-shaped arm structure comprising:

a first side wall portion that faces an inside surface of said window pane, said first side wall portion being integral with an outside lever that is pivotally connected to a base plate of said actuated device;

a second side wall portion that faces an outside surface of said window pane; and a bridge portion that extends between said first and second side wall portions in front of the edge of said window pane, said bridge portion being curved in a direction away from the edge of said window pane.

2. In a door including outer and inner panels which are combined to define therebetween a given space, an arrangement comprising:

a window pane vertically movably installed in said given space;

an actuating device connected to said outer panel;

an actuated device connected to said inner panel;

a movement transmission mechanism for transmitting a movement of said actuating device to said actuated device, said movement transmission mechanism including a U-shaped arm structure that straddles an edge of said window pane leaving a space therebetween;

a flange integral with a base plate of said actuated device, said flange being formed with a vertically extending slot; and a guide pin integral with said U-shaped arm structure and slidably engaged with said vertically extending slot.

3. An arrangement as claimed in claim 2, in which said U-shaped arm structure comprises:

a first side wall portion that faces an inside surface of said window pane, said first side wall portion being integral with an outside lever that is pivotally connected to a base plate of said actuated device;

a second side wall portion that faces an outside surface of said window pane; and a bridge portion that extends between said first and second side wall portions in front of the edge of said window pane.

4. An arrangement as claimed in claim 2, further comprising a vertically extending pane runner with which the edge of said window pane slidably engages and in which said pane runner has a portion which is surrounded by said U-shaped arm structure.

5. In an automotive slide door including outer and inner panels which are combined to define therebetween a given space;

an arrangement comprising:

a window pane vertically movably installed in said given space;

an outside door handle connected to said outer panel;

a locking/unlocking mechanism connected to said inner panel, said locking/unlocking mechanism having an outside lever which induces an unlocked condition of an associated door latch when pivoted in a given direction; and a movement transmission mechanism for transmitting a movement of said outside door handle to the outside lever of said locking/unlocking mechanism to induce the unlocked condition of the door latch, said movement transmission mechanism comprising:

a U-shaped arm structure including a first side wall portion that faces an outside surface of said window pane and is integral with said outside lever, a second side wall portion that faces an outside surface of said window pane and a bridge portion that extends between said first and second side wall portions in front of a front edge of said window pane; and a connecting rod having one end pivotally connected to said outside door handle and the other end pivotally connected to said second side wall portion of said U-shaped arm structure.

6. An arrangement as claimed in claim 5, in which said second side wall portion of said U-shaped arm structure is formed with an arcuate slot with which the other end of said connecting rod is slidably engaged.

7. An arrangement as claimed in claim 6, in which said bridge portion of the U-shaped arm structure is curved in a direction away from the front edge of said window pane.

8. An arrangement as claimed in claim 7, further comprising:

a flange integral with a base plate of said locking/unlocking mechanism, said flange being formed with a vertically extending slot; and a guide pin integral with said U-shaped arm structure and slidably engaged with said vertically extending slot.

* * * * *